US009808686B2

(12) United States Patent
Pactanac et al.

(10) Patent No.: US 9,808,686 B2
(45) Date of Patent: Nov. 7, 2017

(54) GOLF BAG ACCESSORY BAG

(71) Applicant: NIKE, Inc., Beaverton, OR (US)

(72) Inventors: Pierre Pactanac, Portland, OR (US); Heather LeAnne Herron, Portland, OR (US); Mark Andrew Alan, Portland, OR (US); Harlan Charles Peden, III, Sunbury, OH (US); Sherry Lynn Jones, Pataskala, OH (US); James Huang Lua, Columbus, OH (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 14/884,192

(22) Filed: Oct. 15, 2015

(65) Prior Publication Data

US 2017/0106257 A1 Apr. 20, 2017

(51) Int. Cl.

| | |
|---|---|
| ***A63B 55/00*** | (2015.01) |
| ***A63B 55/40*** | (2015.01) |
| ***B65D 21/08*** | (2006.01) |
| ***B65D 33/06*** | (2006.01) |
| ***B65D 33/25*** | (2006.01) |
| *A45C 7/00* | (2006.01) |

(52) U.S. Cl.

CPC ..... *A63B 55/408* (2015.10); *A63B 55/40* (2015.10); *B65D 21/086* (2013.01); *B65D 33/06* (2013.01); *B65D 33/2508* (2013.01); *A45C 7/0063* (2013.01); *A63B 55/00* (2013.01)

(58) Field of Classification Search

CPC ..... A63B 55/00; A63B 55/406; A63B 55/408; A45C 3/004; A45C 7/0077; A45C 7/0063; B65D 21/086; B65D 33/06; B65D 33/2508

USPC ..... 383/4, 6, 2

See application file for complete search history.

(56) References Cited

U.S. PATENT DOCUMENTS

| | | | |
|---|---|---|---|
| 1,254,640 | A | 1/1918 | Stevenson |
| 1,409,323 | A | 3/1922 | Wells |
| 1,444,357 | A | 2/1923 | Madison |
| 1,498,910 | A | 6/1924 | Harpham |

(Continued)

FOREIGN PATENT DOCUMENTS

| | | | |
|---|---|---|---|
| CN | 2410004 | Y | 12/2000 |
| CN | 2526042 | Y | 12/2002 |

(Continued)

OTHER PUBLICATIONS

European Patent Office, European Search Report dated Mar. 20, 2015 in Application No. 12840485.2, 7 pages.

(Continued)

*Primary Examiner* — Peter Helvey

(74) *Attorney, Agent, or Firm* — Honigman Miller Schwartz and Cohn LLP; Matthew H. Szalach; Jonathan P. O'Brien

(57) ABSTRACT

An accessory bag for a main bag is provided and may include a main body extending along a longitudinal axis between a first end and a second end. The main body may be movable between a collapsed state having the first end disposed proximate to the second end and an expanded state having the first end separated from the second end. The accessory bag may further include an attachment device associated with one of the first end and the second end that selectively attaches the main body to the main bag.

25 Claims, 6 Drawing Sheets

(56) References Cited

U.S. PATENT DOCUMENTS 1,899,825 A 2/1933 Reach
2,070,254 A 2/1937 Bergner
2,507,249 A 5/1950 Dorazio
2,791,255 A 5/1957 Ogden
2,799,315 A 7/1957 Strasburg
2,902,287 A 9/1959 Elias
3,147,786 A 9/1964 Kish
D231,042 S * 3/1974 Lee ..... D3/289
3,830,348 A * 8/1974 Ohyama ..... A45C 7/0077 190/107
3,860,157 A 1/1975 Richards et al.
3,912,138 A 10/1975 Pava
3,938,718 A 2/1976 Madison
4,011,898 A * 3/1977 Hubbard ..... A45C 7/0077 150/107
4,085,873 A * 4/1978 Schweitzer ..... A45F 3/04 224/153
4,099,657 A 7/1978 Zufich
4,206,835 A * 6/1980 Shapiro ..... A45C 5/00 190/1
4,248,367 A 2/1981 Buel
4,249,586 A 2/1981 Setani
4,263,950 A * 4/1981 Brown ..... A63B 55/408 206/315.5
4,266,589 A 5/1981 Cochran
4,350,194 A * 9/1982 Brown ..... A63B 55/408 190/110
4,378,039 A 3/1983 Suk
4,420,068 A * 12/1983 Gerch ..... A45C 3/004 190/102
4,438,876 A 3/1984 Ward
4,448,305 A 5/1984 Sup
4,466,659 A 8/1984 Carpentier et al.
D282,602 S * 2/1986 Allen ..... D3/287
D284,425 S * 7/1986 Allen ..... D3/287
D286,229 S * 10/1986 Knoepke ..... 190/103
4,673,070 A 6/1987 Ambal
4,744,446 A * 5/1988 Arney ..... G06F 1/1628 150/111
D296,092 S 6/1988 Dzeskewicz
4,796,752 A 1/1989 Reimers
4,804,121 A * 2/1989 Stanton ..... A63B 57/00 206/315.5
4,895,198 A 1/1990 Samuelson
4,905,827 A * 3/1990 Kim ..... A63B 55/00 206/315.3
5,038,984 A 8/1991 Izzo
5,119,519 A * 6/1992 Foreman ..... A47G 9/1045 190/1
5,176,253 A * 1/1993 Perrin ..... A45C 7/0086 206/315.3
5,222,598 A 6/1993 Yamazoe
5,289,906 A * 3/1994 Guidi ..... A45C 7/0077 190/103
5,314,063 A * 5/1994 Lee ..... A63B 55/00 206/315.5
5,341,928 A * 8/1994 Jones ..... A63B 55/408 190/102
5,399,020 A * 3/1995 Cheng ..... A45C 7/0077 383/121
5,402,883 A * 4/1995 Shin ..... A63B 55/408 206/315.3
5,425,449 A * 6/1995 Boorady ..... A45C 3/004 190/1
5,465,839 A 11/1995 Gretz
5,482,160 A 1/1996 Perrin
5,509,515 A * 4/1996 Guo ..... A45C 7/009 150/111
5,560,479 A * 10/1996 Leyba ..... A45C 13/42 206/315.3
5,632,071 A 5/1997 Maunder
5,632,496 A 5/1997 Nelson
5,704,530 A 1/1998 Scherer
D393,948 S * 5/1998 Cowlen ..... D3/320
5,769,220 A 6/1998 Hong
5,860,519 A * 1/1999 Meyer ..... A63B 55/00 206/315.1
5,873,504 A 2/1999 Farmer
5,941,383 A 8/1999 Cheng
5,956,766 A 9/1999 Benway
6,024,265 A 2/2000 Clements
6,164,425 A * 12/2000 Latshaw ..... A45C 5/14 190/108
6,220,432 B1 * 4/2001 Tan ..... A45C 13/42 206/315.3
6,227,503 B1 5/2001 Shiao Chen
6,276,828 B1 * 8/2001 Otley ..... A45F 4/02 224/576
6,330,944 B1 12/2001 DeMichele
6,415,919 B1 7/2002 Keller
6,478,151 B1 * 11/2002 Schmidt ..... A45C 7/0086 190/108
6,568,852 B1 5/2003 Godshaw et al.
6,637,590 B1 * 10/2003 Matsuki ..... A45C 5/06 206/315.3
6,651,853 B2 11/2003 Higgins et al.
6,736,264 B2 5/2004 Yoshida
6,749,062 B1 * 6/2004 Meissner ..... A63B 55/406 206/315.3
D509,360 S * 9/2005 Cassegrain ..... D3/285
6,994,050 B2 2/2006 Johnson et al.
7,207,426 B2 * 4/2007 Godshaw ..... A45C 3/004 190/1
7,575,376 B2 * 8/2009 Yu ..... A45C 7/0077 190/103
7,650,990 B2 1/2010 Tan
7,780,002 B2 8/2010 Manaster et al.
8,978,850 B2 * 3/2015 Bettua ..... A45C 7/0068 190/103
9,302,162 B1 * 4/2016 Foxman ..... A63B 55/008
2003/0094390 A1 5/2003 Thompson et al.
2003/0168362 A1 9/2003 Yoshida
2004/0108350 A1 6/2004 Warren
2005/0072695 A1 4/2005 Shaanan
2005/0077133 A1 * 4/2005 Cassegrain ..... A45C 5/143 190/18 A
2007/0164064 A1 7/2007 Nathan
2008/0006548 A1 1/2008 Shiao
2010/0051489 A1 3/2010 Shiao
2011/0073504 A1 3/2011 Aubery et al.
2011/0162985 A1 7/2011 Shiao
2014/0061075 A1 3/2014 Leposky et al.
2015/0060221 A1 3/2015 Bourette

FOREIGN PATENT DOCUMENTS

CN 201537363 U 8/2010
EP 2898791 7/2015
JP 2001198250 A 7/2001
JP 2003052877 A 2/2003
JP 2007075296 A 3/2007
WO WO-03061776 7/2003
WO WO-2013056098 A1 4/2013

OTHER PUBLICATIONS

European Patent Office, European Search Report dated Mar. 10, 2015 in Application No. 12840048.8, 7 pages.
International Search Report and Written Opinion dated Jan. 7, 2013 for PCT/US2012/060025, filed Oct. 10, 2012.
International Search Report and Written Opinion dated Jan. 22, 2013 for PCT/US2012/060028, filed Oct. 12, 2012.
U.S., Office Action dated Aug. 6, 2013 for U.S. Appl. No. 13/484,806.
PCT International Preliminary Report on Patentability in International Application No. PCT/US2012/060028, Date of Issuance: Apr. 15, 2014, 6 pages.
U.S., Notice of Allowance in U.S. Appl. No. 13/484,806, dated: Apr. 24, 2014, 18 pages.

(56) References Cited

OTHER PUBLICATIONS

State Intellectual Property Office, Chinese Office Action for Application No. 201280043121.3, dated Sep. 22, 2015.
Japan Patent Office, Japanese Office Action for Application No. 2014-535940 dated Oct. 13, 2015.
U.S., Non-Final Office Action for U.S. Appl. No. 14/475,342, dated Oct. 6, 2016.
U.S., Non-Final Office Action for U.S. Appl. No. 13/273,651, dated Jul. 11, 2014.
U.S., Final Office Action for U.S. Appl. No. 13/273,651, dated Nov. 12, 2014.
U.S., Non-Final Office Action for U.S. Appl. No. 13/273,651, dated Mar. 16, 2015.
U.S., Notice of Allowance for U.S. Appl. No. 13/273,651, dated Aug. 12, 2015.
Japan Patent Office, Notification of Reasons for Refusal for Application No. 2014-535941, dated Jul. 26, 2016.
State Intellectual Property Office, Chinese Office Action for Application No. 201280022397.3, dated Oct. 9, 2015.
Japan Patent Office, Decision of Refusal for Application No. 2014-535940, dated Jun. 21, 2016.
International Searching Authority, International Search Report and Written Opinion for PCT Application No. PCT/US2016/056992, dated Dec. 12, 2016.

* cited by examiner

GOLF BAG ACCESSORY BAG

FIELD

The present disclosure relates to a golf bag and more particularly to a golf bag having one or more detachable accessory bags.

BACKGROUND

This section provides background information related to the present disclosure and is not necessarily prior art.

Golf bags are standard equipment in the game of golf for holding and transporting golf clubs. A golf bag conventionally includes a tubular construction with a closed bottom, an open top, and a carrying strap attached between the closed bottom and the open top. The open top receives one or more golf clubs while the closed bottom and an outer skin or shell of the golf bag defines an interior void to contain the one or more golf clubs. The outer skin or shell may be formed from flexible materials and may be reinforced by a frame formed by one or more support members, such as rails or poles, thereby holding the bag in an open and taut state.

Golf bags are generally designed to include a variety of accessory compartments for holding golf-related items such as golf balls, tees, and towels, as well as for personal items such as beverages, mobile phones, and shoes. Such compartments are permanently attached to the golf bag and, as such, remain part of the bag regardless of whether the golfer utilizes the compartment. While most golfers will sacrifice an increase in size and weight of a golf bag to allow for added storage, the additional size and weight caused by such compartments can lead to fatigue when carrying the golf bag and, as such, can have an adverse effect on the golfer's performance. Further, when such compartments are not used or are used infrequently, the extra size and weight of such pockets becomes a detriment to the golfer's performance without providing any benefit. This adverse effect is generally tolerated because the compartments add utility in certain situations and cannot be removed from the golf bag.

In addition to the foregoing, while conventional golf bag pockets and compartments provide utility when golfing and between rounds of golf (i.e., to store equipment such as golf balls, tees, clothing, and the like), such pockets cannot be removed from the bag for other uses. Namely, golfers do not have the ability to add and remove accessory pockets or compartments from a golf bag to utilize such compartments separately from the golf bag. For instance, after a round of golf, a golfer may need to transport gym shoes stored in a designated accessory compartment for use in another activity. Here, the golfer either needs to remove the gym shoes and place them in a separate bag or transport the entire golf bag along with the other contents of the golf bag. Moreover, golf bags are generally stored outside of the golfer's home due to their size and weight, thereby requiring the golfer to transport items that the golfer desires to use on a particular day between multiple locations in order to pack accessory compartments of the golf bag. Thus, conventional golf bags do not provide a golfer with the ability to pre-pack a golf bag with items or to use accessory compartments separately from the golf bag.

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
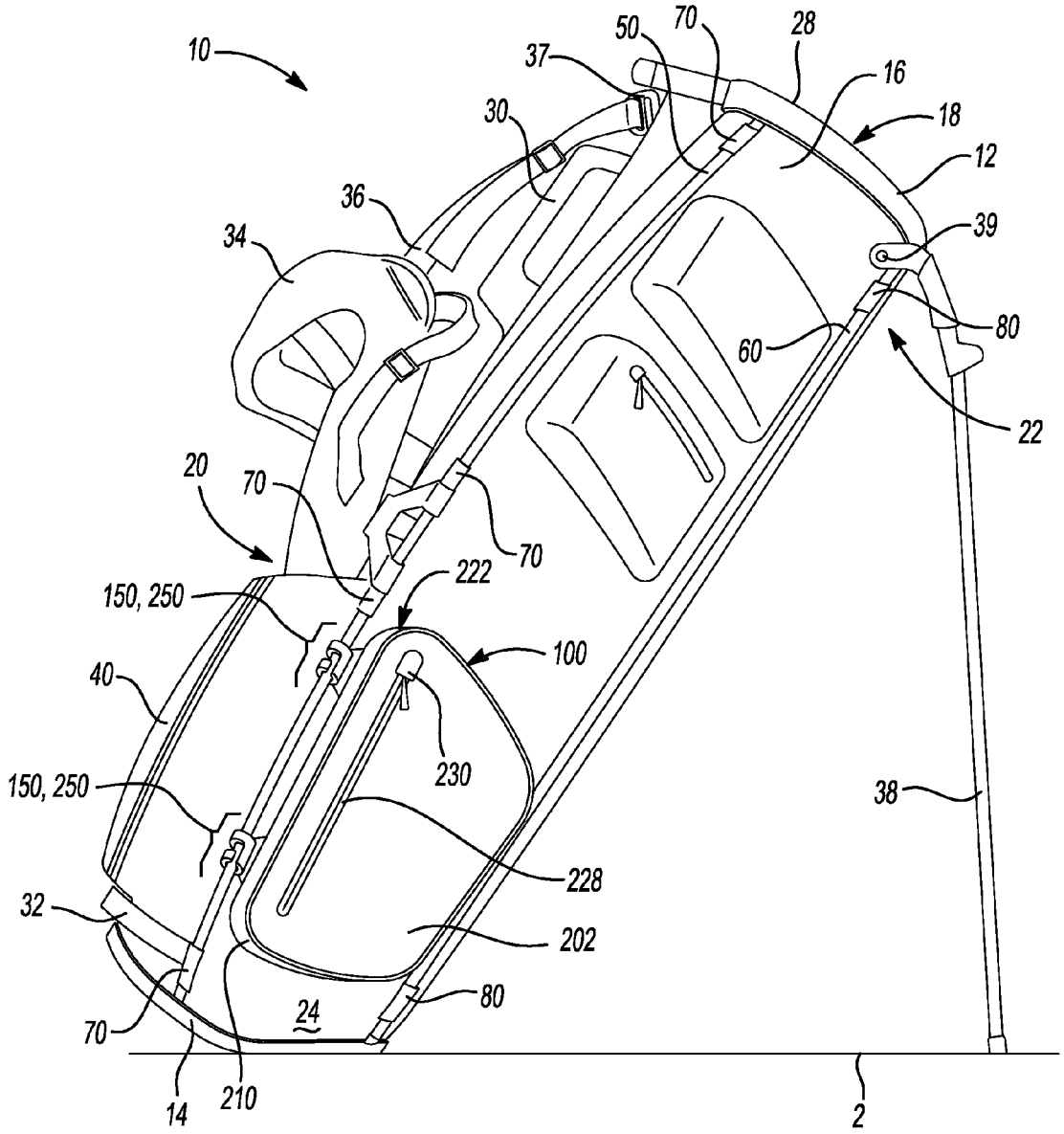
FIG. 1 is a perspective view of a golf bag having a detachable accessory bag in accordance with the principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

With reference to the figures, an accessory bag for a main bag such as a golf bag, for example, is provided and may include a main body extending along a longitudinal axis between a first end and a second end. The main body may be movable between a collapsed state having the first end disposed proximate to the second end and an expanded state having the first end separated from the second end. The accessory bag may further include an attachment device associated with one of the first end and the second end that selectively attaches the main body to the main bag.

In one configuration, the main body defines a first storage compartment having a first volume in the collapsed state and a second volume in the expanded state, the second volume being greater than the first volume. The first storage compartment may be accessible or inaccessible when the main body is in the collapsed state. The main body may include a first closure device movable between a closed state restricting access to the first storage compartment and an open state permitting access to the first storage compartment. In one configuration, the first closure device is hidden from view when the main body is in the collapsed state and extends along the main body substantially parallel to the longitudinal axis. The first closure device may include at least one of a zipper, a button, a snap, and a hook-and-loop fastener.

A second closure device may be associated with the other of the first end and the second end and may be movable between a closed state restricting access to a second storage compartment and an open state permitting access to the second storage compartment. Further, a third closure device may be associated with the one of the first end and the second end and may be movable between a closed state restricting access to a third storage compartment and an open state permitting access to the third storage compartment. In one configuration, the third closure device opposes the main bag when the main body is attached to the main bag.

At least one carry handle may be attached to the main body and may extend between the first end and the second end. The at least one carry handle may be inaccessible when the main body is in the collapsed state.

In one configuration, the first end is attached to the second end when the main body is in the collapsed state.

In another configuration, an accessory bag for a main bag such as a golf bag, for example, is provided and may include a main body extending along a longitudinal axis between a first end and a second end. The main body may be movable between a collapsed state having the first end attached to the second end and an expanded state having the first end separated from the second end. The accessory bag may further include an attachment device associated with one of the first end and the second end that selectively attaches the main body to the main bag.

In one configuration, the main body defines a first storage compartment having a first volume in the collapsed state and a second volume in the expanded state, the second volume being greater than the first volume. The first storage compartment may be accessible or inaccessible when the main body is in the collapsed state. The main body may include a first closure device movable between a closed state restricting access to the first storage compartment and an open state permitting access to the first storage compartment. In one configuration, the first closure device is hidden from view when the main body is in the collapsed state and extends along the main body substantially parallel to the longitudinal axis. The first closure device may include at least one of a zipper, a button, a snap, and a hook-and-loop fastener.

A second closure device may be associated with the other of the first end and the second end and may be movable between a closed state restricting access to a second storage compartment and an open state permitting access to the second storage compartment. Further, a third closure device may be associated with the one of the first end and the second end and may be movable between a closed state restricting access to a third storage compartment and an open state permitting access to the third storage compartment. In one configuration, the third closure device opposes the main bag when the main body is attached to the main bag.

At least one carry handle may be attached to the main body and may extend between the first end and the second end. The at least one carry handle may be inaccessible when the main body is in the collapsed state.

Figure 2:
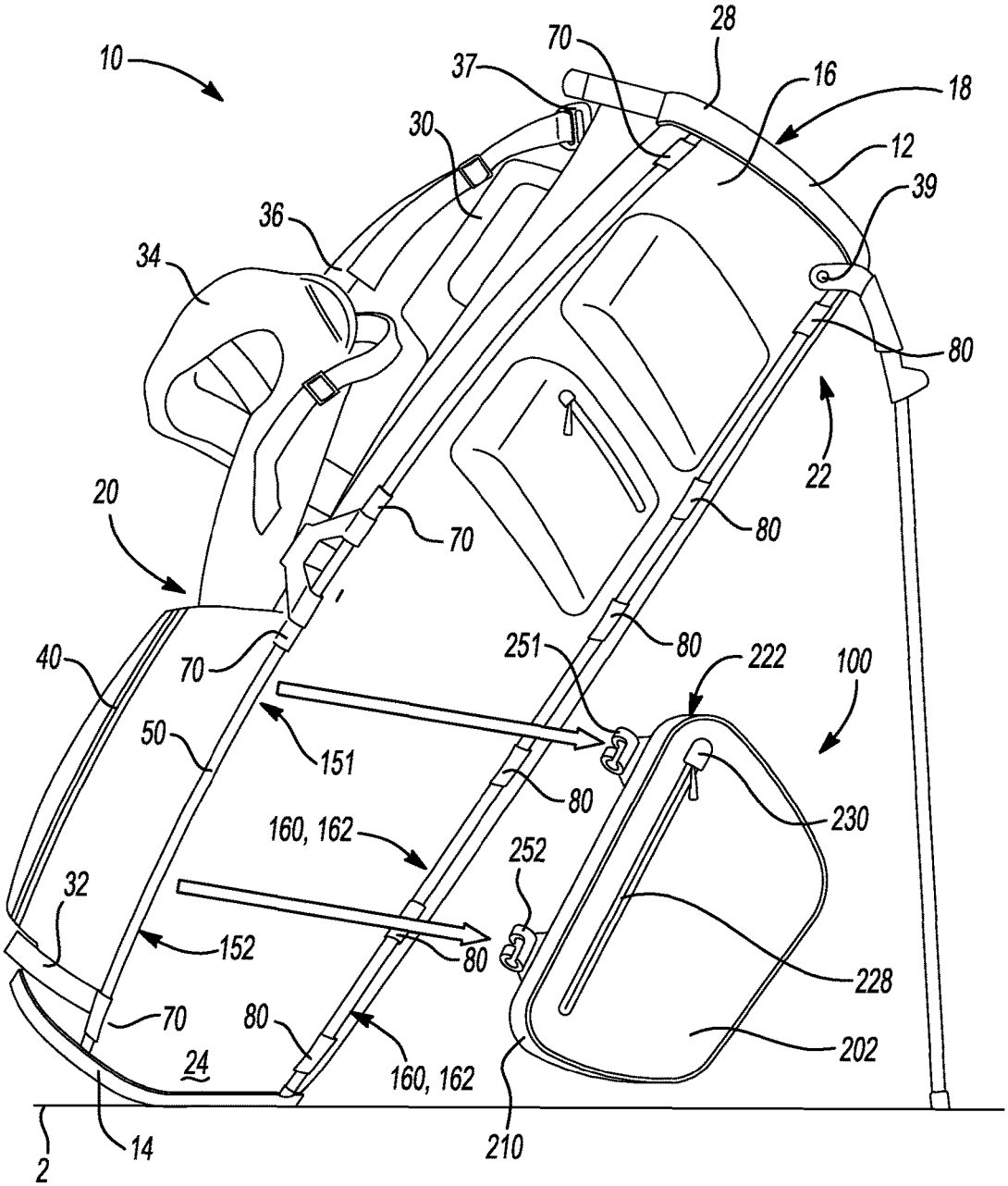
FIG. 2 is a perspective view of the golf bag of FIG. 1 showing the detachable accessory bag in a detached state and removed from the golf bag.

With reference to FIGS. 1 and 2, a golf bag 10 is provided and includes a first support member 12, a second support member 14, a plurality of support rails 50, 60, and a body 16. The golf bag 10 may define a length extending between the first support member 12 and the second support member 14 and may further include a front 20, a rear 22, and opposite sides 24 extending between the front 20 and the rear 22 to define corresponding panels of the golf bag 10 that extend through the length of the golf bag 10. The terms front 20, rear 22, and sides 24 may refer to visible (i.e., exterior) portions of the corresponding panels of the golf bag 10 and may, therefore, be referred to as such herein (e.g., visible side 24).

The plurality of support rails 50, 60 may extend along the length of the golf bag 10 and may connect the first support member 12 and the second support member 14. For example, a proximal end of each support rail 50, 60 may be attached to the first support member 12 and a distal end of each support rail 50, 60 may be attached to the second support member 14. The support rails 50, 60 may extend substantially parallel to one another with at least one of the rails 50, 60 being substantially straight. Additionally or alternatively, at least one of the rails may be slightly curved. The plurality of support rails 50, 60 may be exposed from the golf bag 10 to provide attachment locations 150, 160 for removably attaching accessory bags such as a detachable accessory bag 100 at a location proximate to the visible side 24 of the golf bag 10 in the views of FIGS. 1 and 2. In this regard, the plurality of support rails 50, 60 and/or the attachment locations 150, 160 may be located externally to the front 20, rear 20, and sides 24 that define the corresponding panels of the golf bag 10. As used herein, an "attachment location" refers to any exposed surface of the support rails 50, 60 that allows attachment to and removal of an accessory bag to and from the support rails 50, 60 of the golf bag 10, as will be described below.

The views of FIGS. 1 and 2 each show the first support rail 50 and the second support rail 60 associated with the visible side 24 of the golf bag 10. The first support rail 50 may be disposed proximate to the front 20 of the golf bag 10, while the second support rail 60 may be disposed proximate to the rear 22 of the golf bag 10. At least one of a third support rail and a fourth support rail (neither shown) may be associated with the opposite visible side 24 of the golf bag 10 and may be disposed proximate to respective ones of the front 20 and rear 22 of the golf bag 10. Accordingly, the plurality of support rails 50, 60 may refer to three or more support rails. The three or more support rails may be formed from lightweight and sturdy materials. For example, the rails 50, 60 may be formed from materials including, but not limited to, aluminum and/or titanium.

The body 16 may extend between the first and second support members 12, 14, respectively, and may include interior surfaces that define an interior void 18 that receives and holds one or more golf clubs (not shown). A club opening 28 defined by the first support member 12 may provide access to the interior void 18. For example, the club opening 28 may receive a golf club to hold the golf club within the interior void 18 and facilitate entry and removal of the club from and to the interior void 18. In some examples, a portion of the golf clubs received within the interior void 18 may extend out of the interior void 18 and through the club opening 28 defined by the first support member 12. In some configurations, the first support member 12 includes a lip located around the periphery of the club opening 28 that supports a head portion (not shown) of one or more golf clubs received by the interior void 18. In these configurations, the lip may be formed from an abrasion-resistant material to prevent damaging the head portions of the golf clubs in contact therewith. Additionally or alternatively, the first support member 12 may define one or more dividers (none shown) extending across the club opening 28 to define at least two compartments to suitably arrange and organize the golf clubs received within the interior void 18.

The second support member 14 is disposed on an opposite end of the golf bag 10 than the first support member 12 and may include an inner surface and a ground-engaging surface disposed on an opposite side of the second support member 14. The inner surface may support handles (e.g., grips) of each golf club received by the interior void 18 through the club opening 28 defined by the first support member 12. The second support member 14 may be generally oriented to contact a ground surface 2 when the golf bag 10 is not being carried and, therefore, may provide abrasion-resistance and frictional engagement with the ground surface 2. The second support member 14 may be formed from one or more materials that impart durability and wear-resistance, as well as enhance grip with the ground surface 2. For example, rubber may form at least a portion of the second support member 14.

The plurality of rails 50, 60 may be secured to the body 16 to provide structure to the body 16 by holding the body 16 between the support members 12, 14 in a substantially taut manner with panels of the front, rear, and opposite sides 20, 22, 24, respectively, extending between two or more adjacent rails 50, 60. Thus, the plurality of rails 50, 60 are secured to the body 16 to support the body 16 in an open and extended position to allow entry and removal of the golf clubs to and from the interior void 18. In one configuration, the material of the body 16 includes nylon and/or other lightweight and strong natural and/or synthetic materials.

In some implementations, the plurality of rails 50, 60 are located outside of the body 16 and, as such, are each secured to the body 16 at locations substantially on the exterior of the body 16. For example, a first series of sleeves 70 and a second series of sleeves 80 may be attached to the exterior of the body 16 and may respectively receive a portion of the lengths of corresponding ones of the plurality of rails 50, 60. The first series of sleeves 70 may receive a portion of the first support rail 50 proximate the front 20 of the golf bag 10, while the second series of sleeves 80 may receive a portion of the second support rail 60 proximate the rear 22 of the golf bag 10. While not shown in the views of FIGS. 1 and 2, at least one of a third series of sleeves and a fourth series of sleeves may be associated with the opposite side 24 of the golf bag 10 to surround at least a portion of the lengths of corresponding ones of the third and fourth support rails (neither shown) associated with the opposite side 24 of the golf bag 10.

The sleeves of the first series of sleeves 70 may be spaced apart from one another along the length of the golf bag 10. Further, the sleeves 70 may be aligned with one another along the length of the bag 10 to allow the first support rail 50 to concurrently extend through each sleeve 70 between the first support member 12 and the second support member 14. Each sleeve 70 surrounds a portion of the length of the first support rail 50 to secure the body 16 to the first support rail 50 in an effort to provide structure to the body 16 (i.e., to place the material of the body 16 under tension).

Similarly, each sleeve of the second series of sleeves 80 may be spaced apart from one another along the length of the golf bag 10. As with the first series of sleeves 70, the sleeves of the second series of sleeves 80 may be aligned with one another in a direction extending along a length of the bag 10 to allow the second support rail 60 to concurrently extend through each of the second series of sleeves 80 and between the first support member 12 and the second support member 14. Each sleeve 80 surrounds a portion of the length of the second support rail 60 to secure the body 16 to the second support rail 60 in an effort to provide the aforementioned structure to the body 16.

In other configurations, each series of sleeves 70, 80 may correspond to a single sleeve that runs substantially along the length of its corresponding support rail 50, 60. In such a configuration, the single sleeve includes apertures or holes cut through the sleeve 70, 80 to expose portions of the corresponding support rail 50, 60. The exposed portions may provide attachment locations 150, 160 for removably attaching accessory bags such as the detachable accessory bag 100 to the golf bag 10 via the respective support rails 50, 60. The apertures may be spaced apart from one another along the length of each corresponding support rail 50, 60 to provide attachment locations 150, 160 at various locations along a length of each support rail 50, 60.

In other configurations, the plurality of support rails 50, 60 may be disposed internal to the body 16 and may be secured to the body 16 at locations substantially on the interior surfaces of the body 16 within the interior void 18. Here, the body 16 may include a plurality of slits (none shown) to provide access to the support rails 50, 60 disposed within the interior void 18. Accordingly, the slits formed in the body 16 define attachment locations 150, 160 along a length of each support rail 50, 60 for removably attaching accessory bags such as the detachable accessory bag 100 to the golf bag 10. Thus, slits may be formed in the body 16, and each of the slits may be spaced apart from one another along the length of each corresponding support rail 50, 60.

The golf bag 10 includes one or more retractable legs 38 that selectively support the golf bag 10 in a partially upright position (FIG. 1) on the ground surface 2 when the retractable legs 38 are in a deployed position. For example, each retractable leg 38 may include a proximal end attached to the golf bag 10 at an attachment location 39 disposed proximate to the rear 22 of the golf bag 10 and a distal end that engages the ground surface 2 when the legs 38 are in the deployed position. The retractable legs 38 may move into a retracted position when the golf bag is 10 is lifted off of the ground surface 2, thereby allowing the retractable legs 38 to be positioned adjacent to and substantially parallel with the rear 22 of the golf bag 10.

A grab handle 30 may be located at the front 20 of the golf bag 10 at a location proximate to the first support member 12 to allow the golf bag 10 be carried by a user. Additionally or alternatively, a lift handle 32 may be located at the front 20 of the golf bag 10 at a location proximate to the second support member 14 to allow a user to support the golf bag 10 at the second support member when the bag 10 is carried. One or more accessory storage compartments 40 may be attached to the body 16 or formed therefrom. The one or more accessory storage compartments 40 may be used by a golfer to store golf-related items such as golf balls, tees, and towels, as well as personal items such as beverages, mobile phones, and shoes. The golf bag 10 may also include one or more shoulder straps 34 attached to one or more anchor points 37 disposed on the body 16 via one or more fastening straps 36.

With continued referenced to FIGS. 1 and 2, the detachable accessory bag 100 is shown as being removably attached to the golf bag 10. FIG. 1 shows the bag 100 attached to the golf bag 10 and FIG. 2 shows the bag 100 separated from the golf bag 10. As illustrated in FIGS. 3-7, the bag 100 may define a longitudinal axis L and a length extending between a first and second opposed ends 202, 204. As will be explained in more detail below, the bag 100 may be expandable such that the length of the bag 100 is adjustable in a direction extending substantially parallel to the longitudinal axis L.

The bag 100 may include a proximal end portion 210, a distal end portion 212, a main body portion 214, a closure device 216, and a carrier mechanism 218. The proximal end portion 210 may extend along the longitudinal axis L from the first end 202 to the body portion 214. The distal end portion 212 may extend along the longitudinal axis L from the second end 204 to the body portion 214. Accordingly, the body portion 214 may extend along the longitudinal axis L from and between the proximal and distal end portions 210, 212. In this regard, the body portion 214 may be intermediately and/or centrally located along the longitudinal axis L between the first and second ends 202, 204 of the bag 100. As will be described in more detail below, a length of the body portion 214 along the longitudinal axis L may be adjustable relative to the proximal and distal end portions 210, 212.

One or both of the proximal and distal end portions 210, 212 may include a storage compartment 222. In this regard, the bag 100 may include one or more internal walls 224 that define the storage compartment(s) 222. Each storage compartment 222 may be selectively accessed through openings 228 located in the first and/or second ends 202, 204 of the bag 100. The openings 228 may each be associated with a closure device 230 that selectively closes the openings 228 to prevent access to the particular storage compartment 222. The examples shown in FIGS. 1-6 depict the closure device 230 as including zippers; however, the closure device(s) 230 may include a hook-and-loop fastener or any other suitable mechanism that permits selective access to the particular storage compartment 222.

With reference to FIGS. 4-7, the body portion 214 may include a storage compartment 234. The storage compartment 234 may be defined between at least two of the first end 202, the second end 204, and the internal walls 224. For example, in some configurations, the storage compartment 234 is defined between the internal wall 224 and the second end 204 of the bag 100. In other configurations, the storage compartment 234 may be defined between the first and second ends 202, 204, such that the storage compartments 234, 222 define a single, integrated storage compartment.

Figure 4:
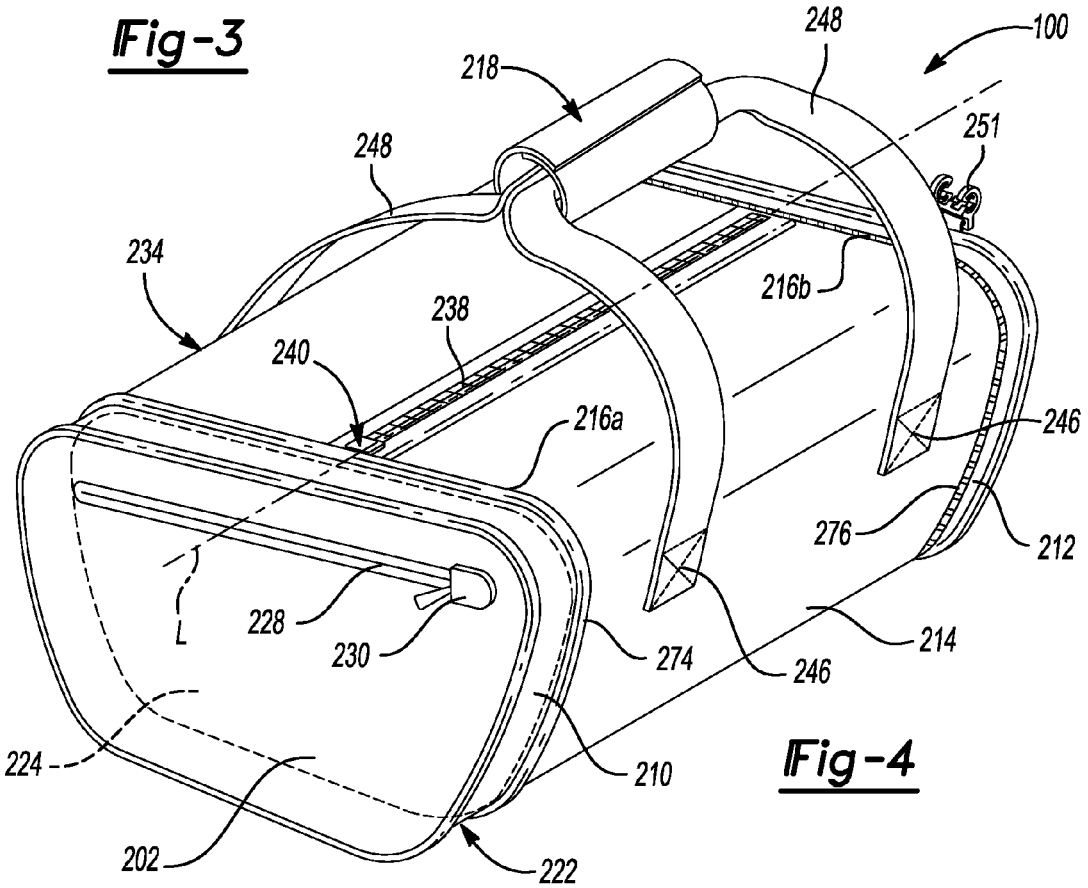
FIG. 4 is a front perspective view of the detachable accessory bag in an expanded state.
Figure 6:
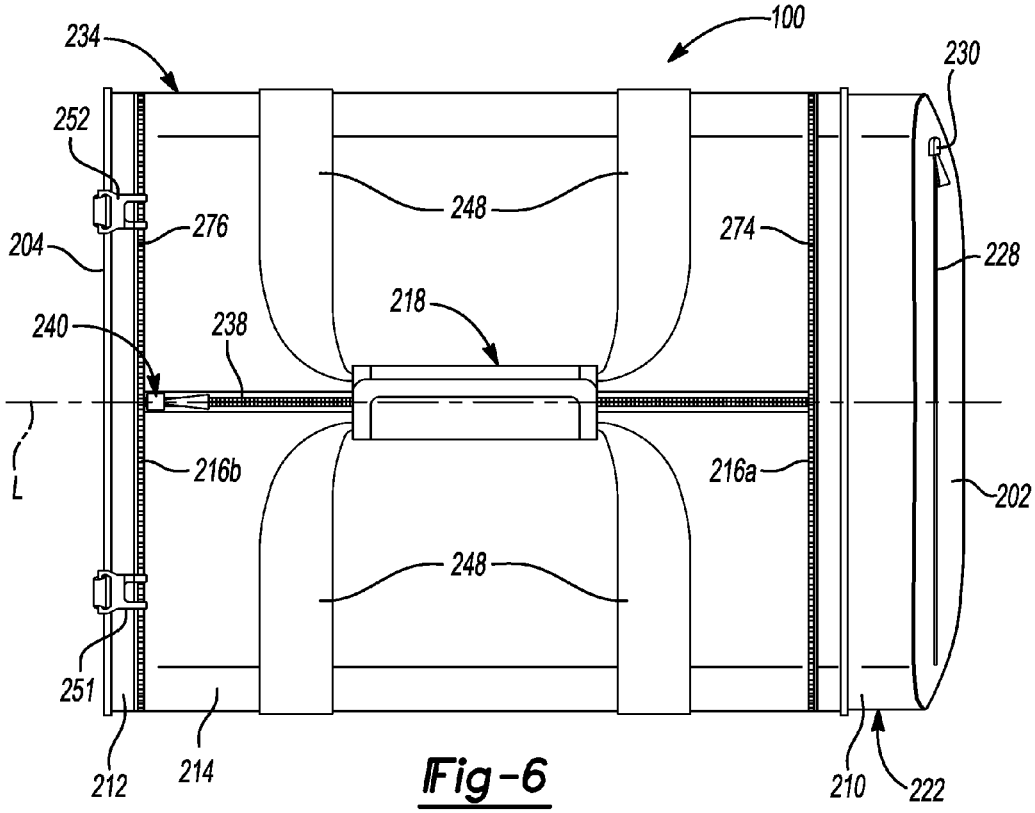
FIG. 6 is a top perspective view of the detachable accessory bag in the expanded state and showing an opening for accessing a storage compartment.
Figure 7:
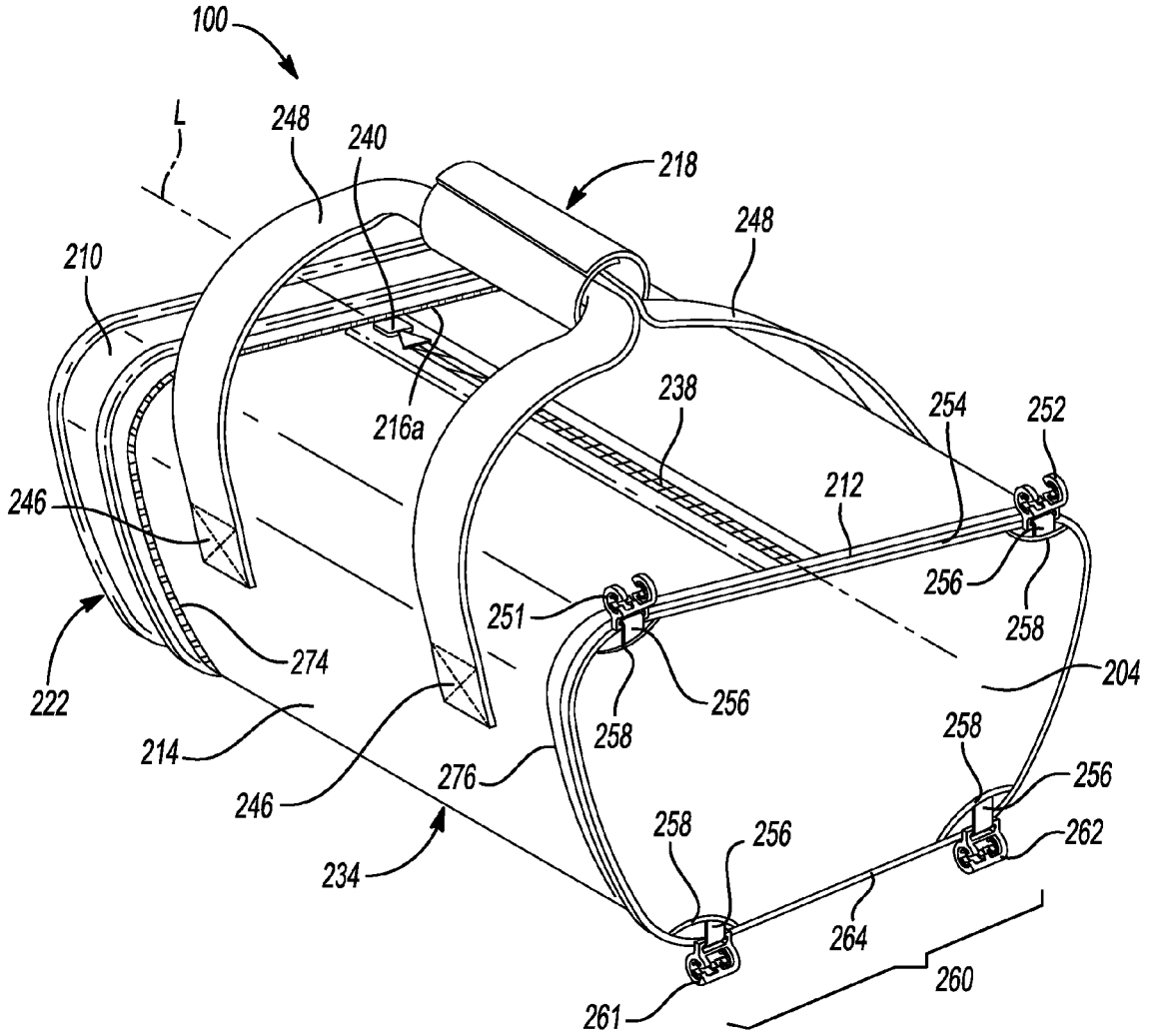
FIG. 7 is a rear perspective view of the detachable accessory bag in the expanded state and showing a first series of attachment mechanisms and a second series of attachment mechanisms.

The storage compartment 234 may be selectively accessed through an opening 238 located in body portion 214 of the bag 100. In some configurations, the opening 238 may extend in a direction substantially parallel to the longitudinal axis L. The opening 238 may be associated with a closure device 240 that selectively closes the opening 238 to prevent access to the storage compartment 234. The examples shown in FIGS. 4, 6, and 7 depict the closure device 240 as including a zipper; however, the closure device 240 may include a hook-and-loop fastener or any other suitable mechanism that permits selective access to the particular storage compartment 234.

Figure 3:
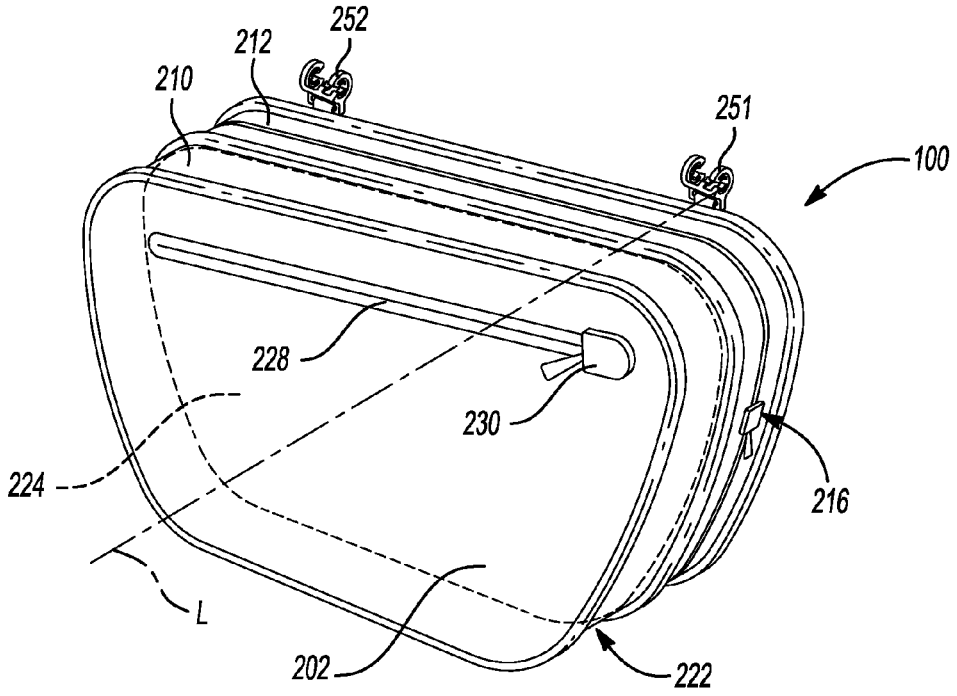
FIG. 3 is a front perspective view of the detachable accessory bag in a collapsed state.
Figure 5:
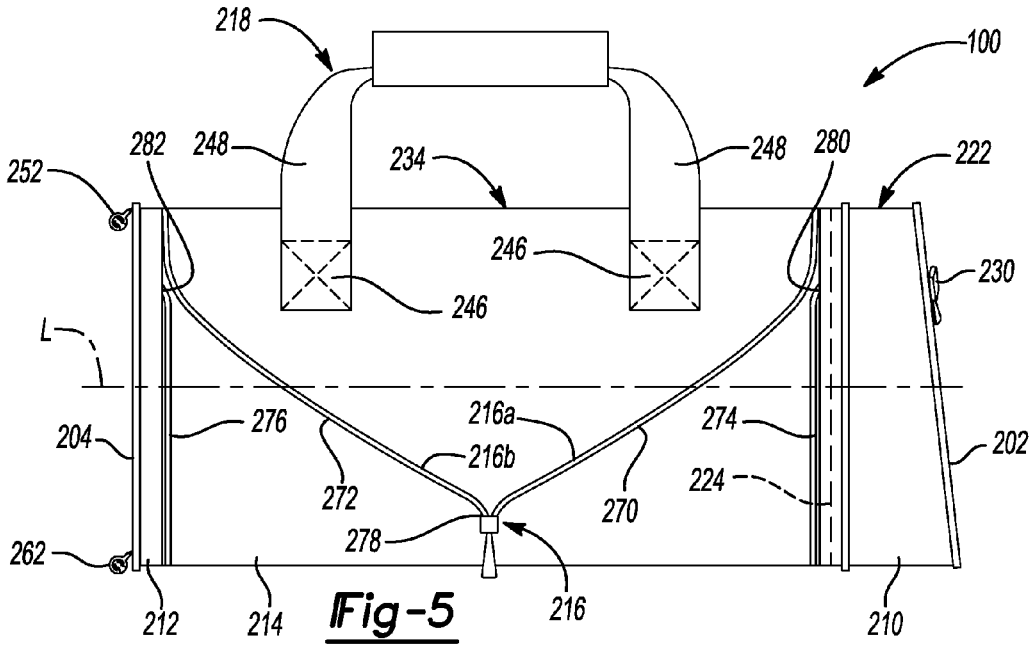
FIG. 5 is a side view of the detachable accessory bag in the expanded state and showing a portion of a closure device.

As illustrated in FIGS. 3 and 5, the closure device 216 may be at least partially disposed about the longitudinal axis L between the first and second ends 202, 204 of the bag 100. The examples shown in FIGS. 3-6 depict the closure device 216 as a zipper; however, the closure device 216 may include a hook-and-loop fastener, a button, a clip, a snap, a tie string, or any other suitable mechanism that permits selectively coupling a first portion 216*a* of the closure device 216 to a second portion 216*b* of the closure device 216 in order to secure the bag 100 in a collapsed state (FIG. 3) and to release the bag 100 to an expanded state (FIG. 4).

With reference to FIG. 5, the closure device 216 may extend about at least a portion of, and/or be disposed in more than one location about, the longitudinal axis L. For example, in some configurations the closure device 216 may include a plurality of snaps, buttons, tie strings, etc. disposed at various locations about the longitudinal axis L. In other configurations, the closure device 216 extends about an entirety (e.g., 360 degrees) of the longitudinal axis L. For example, as illustrated in FIG. 5, the first portion 216*a* may include a first zipper portion, and the second portion 216*b* may include a second zipper portion. The first and second closure portions 216*a*, 216*b* may each include a proximal branch 270, 272, respectively, and a distal branch 274, 276, respectively, extending from a proximal end 278 to a distal end 280, 282, respectively. The proximal branch 270 of the first closure portion 216*a* may be coupled to the body portion 214 and may extend in a first direction from the proximal end 278 toward the first end 202 of the bag 100. The proximal branch 272 of the second closure portion 216*b* may be coupled to the body portion 214 and may extend in a second direction from the proximal end 278 toward the second end 204 of the bag 100. In this regard, the proximal branch 272 of the second closure portion 216*b* may extend in a direction transverse to the direction of the proximal branch 270 of the first closure portion 216*a*, such that the proximal branches 270, 272 define a Y-shape.

The distal branches 274, 276 of the first and second closure portions 216*a*, 216*b* may be coupled to at least one of the body portion 214 and the proximal and distal end portions 210, 212, respectively. For example, in some configurations the distal branch 274 is coupled to the distal end portion 210, and the distal branch 276 is coupled to the distal end portion 212. The distal branches 274, 276 may extend about at least a portion of the longitudinal axis L and a periphery of the bag 100. As illustrated, in some configurations, the distal branches 274, 276 extend about an entirety (i.e., 360 degrees) of the longitudinal axis L. Accordingly, the opening 238 and/or the closure device 240 may extend from the distal branch 274 to the distal branch 276.

The carrier mechanism 218 allows a user to lift the bag 100 by applying a force on the bag 100 via the carrier mechanism 218 when the bag 100 is separated from the golf bag 10 in an expanded state (FIG. 4). In this regard, the bag 100 may also include a lift strap (not shown), or other suitable carrying mechanism that allows a user to carry the bag 100 when the bag is in the collapsed state (FIG. 3). The carrier mechanism 218 may be coupled to one or more anchor points 246 disposed on the bag 100 via one or more fastening straps 248 and may be hidden from view and/or inaccessible when the body portion 214 is in the collapsed state. As illustrated in FIG. 4, in some configurations, two anchor points 246 may be disposed on a first lateral side of the body portion 214, and two anchor points 246 may be disposed on a second lateral side (opposite the first lateral side) of the body portion 214. The anchor points 246 may include various types of fasteners such as stitching, buttons, snaps, and/or hook-and-loop fasteners.

As described herein, the bag 100 may be expandable and collapsible in a direction extending generally parallel to the longitudinal axis L. In this regard, the first closure portion 216*a* of the closure device 216 may be engaged with the second closure portion 216*b* of the closure device 216 to secure the bag 100 in a collapsed configuration (FIG. 3), while the first closure portion 216*a* of the closure device 216 may be disengaged from the second closure portion 216*b* of the closure device 216 to allow the bag 100 to assume an expanded configuration (FIG. 4). In the collapsed configuration, the bag 100 may define a first storage volume. In the expanded configuration, the bag 100 may define a second storage volume that is greater than the first storage volume. In the collapsed configuration, a user may access the storage compartments 222 and/or 234 through the opening 228. In this regard, the carrier mechanism 218 and the body portion 214 may be stored (e.g., radially inward of the closure device 216 and inaccessible to a user) within the bag 100 in the collapsed configuration. In contrast, in the expanded configuration, a user may access the carrier mechanism 218 and both the storage compartment(s) 222 and the storage compartment 234 through the opening(s) 228, 238, respectively.

The bag 100 may also include a first series of attachment mechanisms 250 each movable between an attached state and a detached state. FIG. 1 shows the first series of attachment mechanisms 250 in the attached state. Here, the first series of attachment mechanisms 250 attach to the first series of attachment locations 150 of the first support rail 50, thereby attaching the bag 100 to more than one attachment location 150 of the golf bag 10. Conversely, FIG. 2 shows each of the first series of attachment mechanisms 250 in the detached state to allow the bag 100 to be separated from the first attachment locations 150 and, thus, from the golf bag 10.

Referring to FIGS. 2 and 7, in some implementations, the first series of attachment mechanisms 250 includes a first attachment mechanism 251 and a second attachment mechanism 252 each movable between the attached state and the detached state. The first and second attachment mechanisms 251, 252, respectively, may be spaced apart from one another in a direction substantially perpendicular to the longitudinal axis L of the bag 100. In this regard, the first and second attachment mechanisms 251, 252 may be located proximate to a proximal edge 254 of the second end 204 of the bag 100. In some examples, the first attachment mechanism 251 attaches to the first support rail 50 at a first attachment location 151 of the first series of attachment locations 150. Similarly, the second attachment mechanism 252 attaches to the first support rail 50 at a second attachment location 152 of the first series of attachment locations 150.

FIG. 7 provides a rear perspective view of the detachable accessory bag 100 showing the second end 204 of the bag 100 disposed on an opposite side of the bag 100 than the first end 202. The first and second attachment mechanisms 251, 252, respectively, may attach to the second end 204 of the bag 100. In some examples, at least one of the attachment mechanisms 251, 252 attaches to the bag 100 via a corresponding extension strap 256. Here, the extension straps 256 may provide the attachment mechanisms 251, 252, with a degree of movement relative to the bag 100 to help facilitate attachment to and removal from the corresponding attachment locations 151, 152, disposed along the length of the first support rail 50 of the golf bag 10.

In some configurations, the bag 100 may optionally include a second series of attachment mechanisms 260 each movable between an attached state and a detached state. In the attached state, the attachment mechanisms 260 attach to the second series of attachment locations 160 of the second support rail 60. Accordingly, the attachment mechanisms 260 allow the bag 100 to be selectively attached to the golf bag 10 via the attachment locations 160 of the second support rail 60. As shown in FIG. 7, the second series of attachment mechanisms 260 includes a first attachment mechanism 261 and a second attachment mechanism 262 each movable between the attached state and the detached state. The first attachment mechanism 261 and the second attachment mechanism 262 may be spaced apart from one another in a direction substantially perpendicular to the longitudinal axis L of the bag 100. In this regard, the first and second attachment mechanisms 261, 262 may be disposed proximate to a distal edge 264 (opposite the proximal edge 254) of the second end 204 of the bag 100.

Referring to FIGS. 2 and 7, the first attachment mechanism 261 attaches to the second support rail 60 at a first attachment location 161 of the second series of attachment locations 160. Similarly, the second attachment mechanism 262 attaches to the second support rail 60 at a second attachment location 162 of the second series of attachment locations 160.

The first and second attachment mechanisms 261, 262, respectively, may be attached to the rear side 220 of the bag 100. In some configurations, at least one of the attachment mechanisms 261, 262 attaches to the bag 100 via a corresponding extension strap 256 in a similar fashion as the attachment mechanisms 251, 252. As with the attachment mechanisms 251, 252, the extension straps 256 may provide the attachment mechanisms 261, 262 with a degree of movement relative to the bag 100, as discussed above with reference to the first series of attachment mechanisms 250. Alternatively, the straps 256 may include a length that places the rear side second side 204 of the accessory bag 100 under tension when the attachment mechanisms 251, 252, 261, 262 are respectively attached to the support rails 50, 60 to restrict relative movement between the golf bag 10 and the accessory bag 100. In some configurations, the second end 204 of the bag 100 may include one or more pockets 258, each corresponding to a respective extension strap 256 and to one of the attachment mechanisms 251, 252, 261, 262. The pocket(s) 258 can receive and/or conceal the extension strap(s) 256 and/or the attachment mechanisms 251, 252, 261, 262 when the bag 100 is detached from the golf bag 10.

In some examples, the second series of attachment mechanisms 260 extend along the length of the bag 100 substantially in parallel with the first series of attachment mechanisms 250. The second series of attachment mechanisms 260 may be spaced apart from the first series of attachment mechanisms 250 by a separation distance substantially equal to a separation distance between the first support rail 50 and the second support rail 60 of the golf bag 10. Accordingly, the second series of attachment mechanisms 260 may cooperate with the first series of attachment mechanisms 250 to secure the bag 100 to the golf bag 10 when the attachment mechanisms 250, 260 are in their attached states at the attachment locations 150, 160 of the first support rail 50 and the second support rail 60, respectively. Securing the attachment mechanisms 250, 260 to the respective support rails 50, 60 restricts relative movement between the bag 100 and the golf bag 10 when the golf bag 10 is being transported. Such movement may be further restricted if attachment of the mechanisms 250, 260 to the respective support rails 50, 60 places the second end 204 of the accessory bag 100 in tension. Regardless of whether attachment of the attachment mechanisms 250, 260 to the respective support rails 50, 60 results in the second end 204 being placed in tension, attachment of the mechanisms 250, 260 to the respective support rails 50, 60 permits the detachable accessory bag 100 to appear integral to the golf bag 10. In other words, when the accessory bag 100 is detached from the golf bag 10 (FIG. 2), the accessory bag 100 takes the appearance of a conventional accessory bag in the collapsed state (FIG. 3) and a conventional duffel bag in the expanded state (FIG. 4). In contrast, when the accessory bag 100 is attached to the support rails 50, 60 via the attachment mechanisms 250, 260 (FIG. 1), the accessory bag 100 takes the appearance of a conventional pocket of the golf bag 10.

The attachment mechanisms 250, 260 may be clips that are formed from a resilient material such as, for example, plastic. The material of the attachment mechanisms 250, 260 allows the mechanisms 250, 260 to be biased into the attached state and resiliently deflected from the attached state into the detached state. For example, a force may be exerted on the attachment mechanisms 250, 260 when the mechanisms 250, 260 respectively engage the support rails 50, 60 due to engagement between the clips 250, 260 and the respective support rails 50, 60. The applied force may cause the clips 250, 260 to deflect and snap onto the support rails 250, 260. Once attached to the support rails 50, 60, the material of the clips 250, 260 causes the clips 250, 260 to securely engage the rails 50, 60. Similarly, when a force is applied to the clips 250, 260 to remove the clips 250, 260 from the rails 50, 60, the clips 250, 260 are once again deflected to permit the clips 250, 260 to be detached from the support rails 50, 60. While the attachment mechanisms 250, 260 are described and shown as being clips, the attachment mechanisms 250, 260 could be any mechanism that permits the accessory bag 100 to be selectively attached to the golf bag 10 via the support rails 50, 60.

Figure 8:
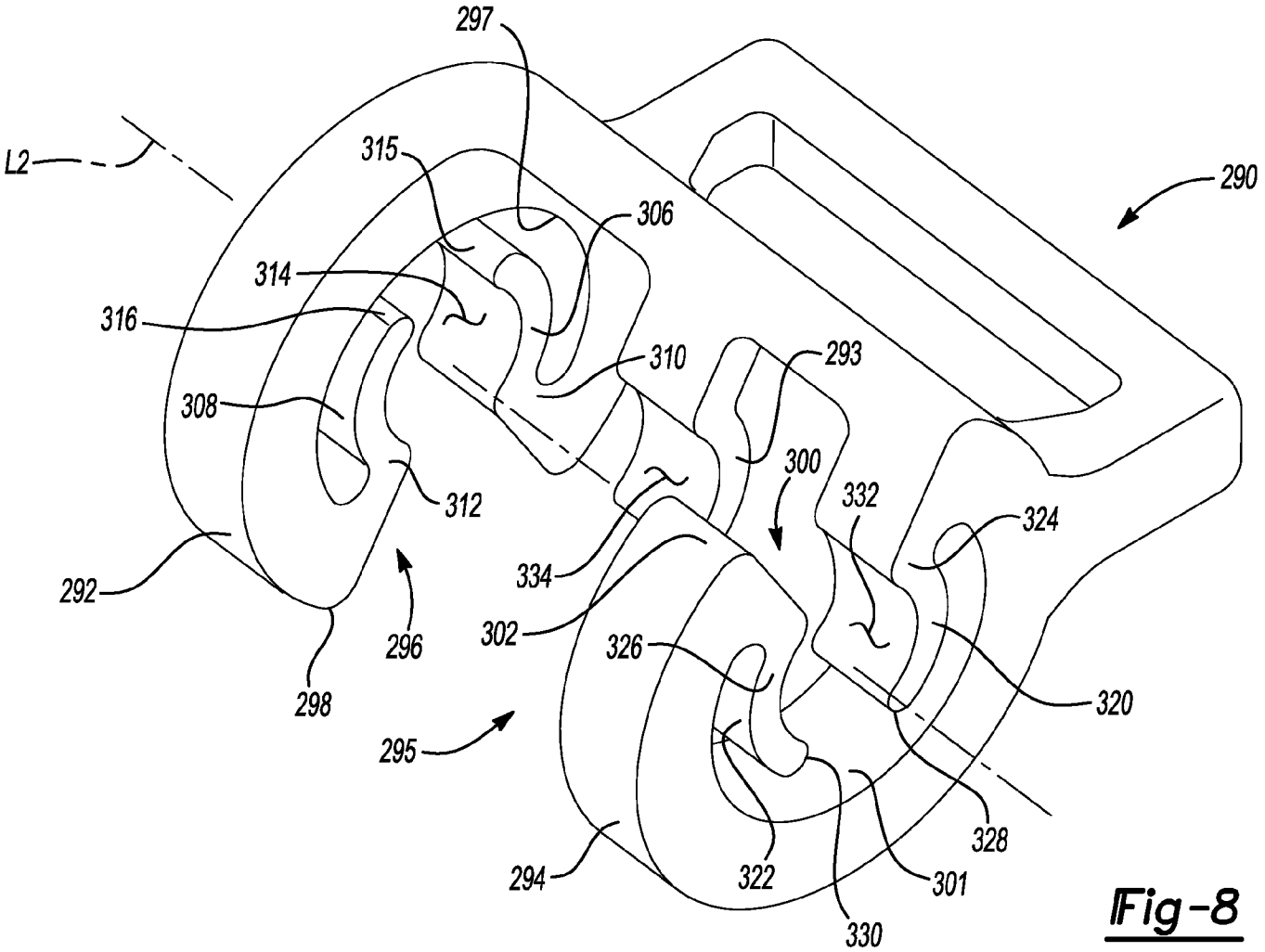
FIG. 8 is a perspective view of an attachment mechanism of the first and second series of attachment mechanisms of FIG. 7.

With reference to FIG. 8, one example of an attachment mechanism 250, 260 is illustrated as a clip 290. The clip 290 may define a longitudinal axis L2 and may include a first attachment arm 292, a second attachment arm 294, and a support finger 293. The second attachment arm 294 may be substantially similar to the first attachment arm 292, apart from any exceptions described below and/or shown in the figures. The first attachment arm 292 may be offset from the second attachment arm 294 in a direction extending along the longitudinal axis L2. In this regard, the first and second attachment arms 292, 294 may define a void 295 therebetween. The void 295 may extend along the longitudinal axis L2 between the first and second attachment arms 292, 294.

The first attachment arm 292 may include a first opening 296 and a first cavity 297. The first opening 296 may be formed in a first side 298 of the clip 290. The second attachment arm 294 may include a second opening 300 and a second cavity 301. The second opening 300 may be formed in a second side 302 of the clip 290. The first side 298 may be opposite the second side 302 such that the first and second openings 296, 300 face opposite directions. The first and second openings 296, 300 may open into the first and second cavities 297, 301, respectively.

The first attachment arm 292 may further include a pair of opposed first and second fingers 306, 308 extending into the first cavity 297 from the first opening 296. In this regard, the first and second fingers 306, 308 may include a fixed proximal end 310, 312, respectively, coupled to the first attachment arm 292, and a free, cantilevered distal end 315, 316, respectively, disposed within the first cavity 297, allowing the first and second fingers 306, 308 to flex within the cavity 297. The first finger 306 may include a first engagement surface 314 facing the longitudinal axis L2. The second finger 308 may include a second engagement surface (not shown) facing the longitudinal axis L2 and the first engagement surface 314. In some configurations, the first engagement surface 314 and/or the second engagement surface may include a concave construct, such that the first engagement surface 314 and/or the second engagement surface extend about at least a portion of the longitudinal axis L2.

The second attachment arm 294 may further include a pair of third and fourth opposed fingers 320, 322 extending into the second cavity 301 from the second opening 300. In this regard, the third and fourth fingers 320, 322 may include a fixed proximal end 324, 326, respectively, coupled to the second attachment arm 294, and a free distal end 328, 330, respectively, disposed within the second cavity 301, allowing the third and fourth fingers 320, 322 to flex within the cavity 301. The third finger 320 may include a third engagement surface 332 facing the longitudinal axis L2. The fourth finger 308 may include a fourth engagement surface (not shown) facing the longitudinal axis L2 and the third engagement surface 332. In some configurations, the third engagement surface 314 and/or the fourth engagement surface may include a concave construct, such that the third engagement surface 332 and/or the fourth engagement surface extend about at least a portion of the longitudinal axis L2.

The longitudinal axis L2 may extend between the first and second fingers 306, 308 of the first attachment arm 292 and between the third and fourth fingers 320, 322 of the second attachment arm 294.

The support finger 293 may be located between the first and second attachment arms 292, 294 along the longitudinal axis L2. The support finger 293 may include a fifth engagement surface 334 facing the longitudinal axis L2. The fifth engagement surface 334 may include a concave construct, such that the fifth engagement surface 334 extends about at least a portion of the longitudinal axis L2.

In operation, the bag 100 may be selectively attached to, and detached from, the golf bag 10 by the attachment mechanisms 250, 260. For example, the attachment mechanisms 251, 252, in the form of the clip 290, may be coupled and/or decoupled from the attachment locations 151, 152 of the support rail 50, and the attachment mechanisms 261, 262, in the form of the clip 290, may be coupled and/or decoupled from the attachment locations 161, 162 of the support rail 50. In particular, to attach the bag 100 to the golf bag 10, each support rail 50, 60 may be positioned within the void 295 of one or more of the clips 290. In this regard, the support rails 50, 60 may be positioned such that the rails 50, 60 extend in a direction transverse to the longitudinal axis L2 of the clip 290. The clip 290 may be rotated such that the respective support rail 50, 60 is received within a respective opening 296, 300 of the first and second attachment arms 292, 294. The clip 290 may be further rotated into a locked position such that respective the support rail 50, 60 is received between the first engagement surface 314 and the second engagement surface of the first and second fingers 306, 308, and between the third engagement surface 332 and fourth engagement surface of the third and fourth fingers 320, 322. In this regard, the first, second, third, and fourth fingers 306, 308, 320, 322 may flex to receive the support rails 50, 60 therebetween. In the locked position, the rails 50, 60 may further engage the fifth engagement surface 334 of the support finger 293, such that the rails 50, 60 extend in a direction substantially parallel (+/−5 degrees) to the longitudinal axis L2.

The bag 100 may be moved into the extended state by moving one of the first and second ends 202, 204 relative to, and away from, the other of the first and second ends 202, 204 along the longitudinal axis L of the bag 100 to increase the volume of the storage compartment 206. While in the extended state, the bag 100 includes an increased length extending between the first and second ends 202, 204, relative to the length extending between the first and second ends 202, 204 in the collapsed state. In this regard, in the expanded state, the openings 228 and 238 may be accessible to a user, while, in the collapsed state, the opening 228 may be accessible to the user and the opening 238 may be inaccessible to the user. The increased volume of the storage compartment 206 allows the accessory bag 100 to hold and carry various pieces of athletic equipment and the like (e.g., apparel, golf balls, beverages, etc.). With particular reference to FIGS. 1-4, the detachable accessory bag 100 is shown as being used as a so-called duffel bag. Advantageously, in one method of use, the bag 100 can be expanded (FIG. 4) and detached from the golf bag 10 (FIG. 2) to store and transport the various pieces of athletic equipment and the like, and, in another method of use, can be collapsed (FIG. 3) and attached to the golf bag 10 (FIG. 1) to provide for convenient storage and transportation of the combined golf bag 10 and accessory bag 100.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A bag comprising:

exposed poles extending along a longitudinal axis of the bag; and an accessory bag comprising:

a main body extending along a longitudinal axis of the accessory bag between a first end and a second end, the main body movable between a collapsed state having the first end disposed proximate to the second end and an expanded state having the first end separated from the second end; and an attachment device associated with one of the first end and the second end and operable to selectively attach the main body to the exposed poles.

2. The bag of claim 1, wherein the main body defines a first storage compartment having a first volume in the collapsed state and a second volume in the expanded state, the second volume being greater than the first volume.

3. The bag of claim 2, wherein the first storage compartment is accessible via the same opening when the main body is in the collapsed state and the expanded state.

4. The bag of claim 2, wherein the main body includes a first closure device operable between a closed state restricting access to the first storage compartment and an open state permitting access to the first storage compartment.

5. The bag of claim 4, wherein the first closure device is hidden from view when the main body is in the collapsed state.

6. The bag of claim 4, wherein the first closure device extends along the main body substantially parallel to the longitudinal axis of the main body.

7. The bag of claim 6, wherein the first closure device includes at least one of a zipper, a button, a snap, and a hook-and-loop fastener.

8. The bag of claim 4, further comprising a second closure device associated with the other of the first end and the second end, the second closure device operable between a closed state restricting access to a second storage compartment and an open state permitting access to the second storage compartment.

9. The bag of claim 8, further comprising a third closure device associated with the one of the first end and the second end, the third closure device operable between a closed state restricting access to a third storage compartment and an open state permitting access to the third storage compartment.

10. The bag of claim 9, wherein the third closure device opposes the bag when the main body is attached to the bag.

11. The bag of claim 1, further comprising at least one carry handle attached to the main body, the carry handle extending between the first end and the second end.

12. The bag of claim 11, wherein the at least one carry handle is inaccessible when the main body is in the collapsed state.

13. The bag of claim 1, wherein the first end is attached to the second end when the main body is in the collapsed state.

14. A bag comprising:

exposed poles extending along a longitudinal axis of the bag; and an accessory bag comprising:

a main body extending along a longitudinal axis of the accessory bag between a first end and a second end, the main body movable between a collapsed state having the first end attached to the second end and an expanded state having the first end separated from the second end; and an attachment device associated with one of the first end and the second end and operable to selectively attach the main body to the exposed poles.

15. The bag of claim 14, wherein the main body defines a first storage compartment having a first volume in the collapsed state and a second volume in the expanded state, the second volume being greater than the first volume.

16. The bag of claim 15, wherein the first storage compartment is accessible via the same opening when the main body is in the collapsed state and the expanded state.

17. The bag of claim 15, wherein the main body includes a first closure device operable between a closed state restricting access to the first storage compartment and an open state permitting access to the first storage compartment.

18. The bag of claim 17, wherein the first closure device is hidden from view when the main body is in the collapsed state.

19. The bag of claim 17, wherein the first closure device extends along the main body substantially parallel to the longitudinal axis of the main body.

20. The bag of claim 19, wherein the first closure device includes at least one of a zipper, a button, a snap, and a hook-and-loop fastener.

21. The bag of claim 17, further comprising a second closure device associated with the other of the first end and the second end, the second closure device operable between a closed state restricting access to a second storage compartment and an open state permitting access to the second storage compartment.

22. The bag of claim 21, further comprising a third closure device associated with the one of the first end and the second end, the third closure device operable between a closed state restricting access to a third storage compartment and an open state permitting access to the third storage compartment.

23. The bag of claim 22, wherein the third closure device opposes the bag when the main body is attached to the bag.

24. The bag of claim 14, further comprising at least one carry handle attached to the main body, the carry handle extending between the first end and the second end.

25. The bag of claim 24, wherein the at least one carry handle is inaccessible when the main body is in the collapsed state.

* * * * *